United States Patent [19]

Hall et al.

[11] 4,008,592

[45] Feb. 22, 1977

[54] METHOD AND APPARATUS FOR FLANGING A LENGTH OF SPIRALLY WOUND CORRUGATED PIPE

[75] Inventors: Robert E. Hall, Newport Beach; Clyde Lamar, West Sacramento, both of Calif.

[73] Assignee: W. E. Hall Company, Irvine, Calif.

[22] Filed: July 23, 1975

[21] Appl. No.: 598,173

[52] U.S. Cl. ..... 72/70; 72/106

[51] Int. Cl.[2] ..... B21D 19/04

[58] Field of Search ..... 72/70, 105, 106

[56] References Cited

UNITED STATES PATENTS

| | | | |
|---|---|---|---|
| 2,182,401 | 12/1939 | Kreis et al. | 72/106 |
| 2,239,696 | 4/1941 | Bohm | 72/70 |
| 2,809,687 | 10/1957 | Ogle | 72/105 |
| 3,548,623 | 12/1970 | Hess et al. | 72/106 |
| 3,648,503 | 3/1972 | Harper | 72/105 |
| 3,662,579 | 5/1972 | Lewis | 72/105 |

*Primary Examiner*—Lowell A. Larson
*Attorney, Agent, or Firm*—Lyon & Lyon

[57] ABSTRACT

Disclosed herein is an assembly for forming a radial end flange upon a length of spirally wound corrugated metal pipe. The assembly includes a head stock having a pair of rotatably driven flanging rollers for preparing the end of the pipe to be flanged and initiating the flange, an ironing wheel mounted perpendicularly with respect to the flanging rollers for completing the flange, and a shearing wheel associated with one of the flanging rollers for removing excess metal from the formed end flange. The assembly also includes a tail stock having upper and lower support rollers for securely supporting the other end of the pipe and a center turntable support for positioning the length of pipe to be flanged.

26 Claims, 8 Drawing Figures

METHOD AND APPARATUS FOR FLANGING A LENGTH OF SPIRALLY WOUND CORRUGATED PIPE

BACKGROUND OF THE INVENTION

Corrugated metal pipe is widely used for underground drains, culverts and other pipelines. To facilitate pipe construction and flexibility, such pipe is often helically wound wherein the corrugations and lock or welded seam extend helically around and along the length of pipe. In the trade, such pipe is termed either spirally or helically wound corrugated pipe. In laying a pipeline comprised of such pipe, the lengths of pipe after forming are taken to the job site where they are joined together by large split bands having spiral or helical corrugations which bands are placed about the juncture of butting or overlapping adjacent pipe lengths. Brackets are secured to the ends of the split bands which are drawn together by bolts extending between the brackets, thereby forming a seal between adjacent pipe lengths.

Another method of forming a pipeline from pipe lengths having annular — not spiral — corrugations is to flare the ends of the individual lengths of pipe outwardly to form end flange prior to transporting the lengths of pipe to the job site. Pipe with annular corrugations cost more to manufacture than pipe with spiral corrugations, but it can easily be provided with end flanges. At the job site, these flanged pipe lengths are then joined together by channel band couplers, such as that described in applicant's co-pending United States patent application, Ser. No. 428,263 now abandoned. While methods and apparatus have been developed by applicant for flanging a length of pipe, having annular corrugations, such methods and apparatus are not suited for flanging a length of spirally wound corrugated pipe. Accordingly, the superior channel type coupler has not heretofore been compatible with spirally wound corrugated pipe.

SUMMARY OF THE INVENTION

Briefly, the invention comprises an assembly for forming a radial end flange upon a length of spirally wound corrugated steel pipe. The assembly includes a pair of recorrugating and flanging rollers which apply in annular corrugation to the end of the spirally wound pipe and initiate the formation of a flange. After the flange is initially formed, an ironing wheel is activiated to press the flange into a perpendicular disposition with respect to the longitudinal axis of the length of pipe and a shearing wheel is employed to remove the excess metal from the formed flange. Central and rear supports are provided to secure and support the length of pipe as the flange is formed thereon.

It is the principal object of the present invention to provide an apparatus for forming a radial end flange therefore upon a length of spirally wound corrugated steel pipe.

This and other objects and advantages of the present invention will become apparent from the following detailed description taken in conjunction with the accompanying drawings.

IN THE DRAWINGS

DESCRIPTION OF A PREFERRED EMBODIMENT

Figure 5:
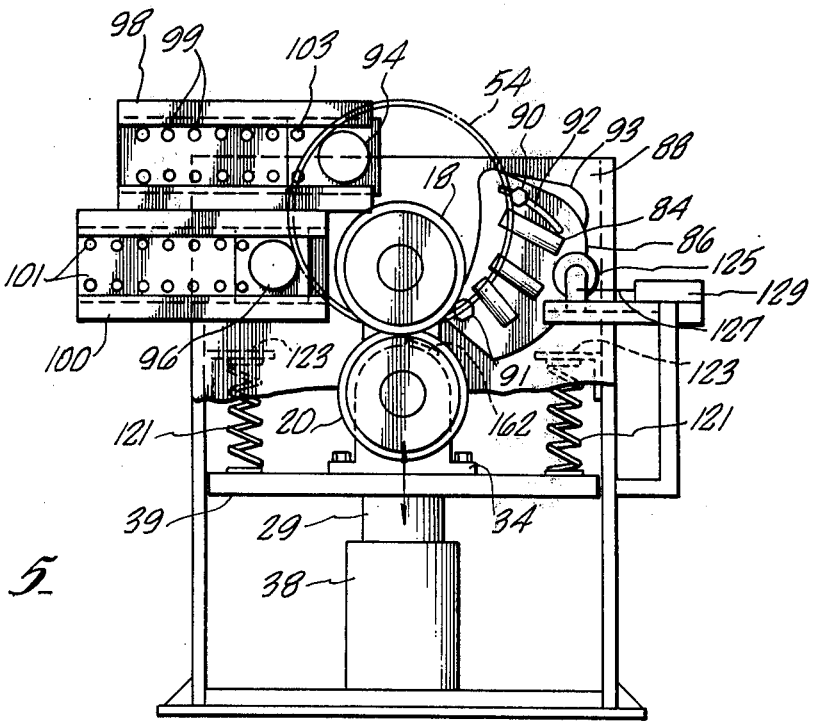
FIG. 5 is a frontal view of the head stock.

Referring now in detail to the drawings, the flanging assembly 10 is comprised of a head stock 12, central pipe support 14 and tail stock 16. The head stock, shown most clearly in FIGS. 1 and 3, includes an upper recorrugating and flanging roller 18, lower recorrugating and flanging roller 20 and drive motor 22. The upper and lower rollers 18 and 20 have annular corrugations 24 on the surfaces thereof and are mounted on shafts 26 and 28, respectively. Drive shaft 26 is rotatably mounted and supported in a pair of fixed pillow blocks 30 and 31 and is mechanically linked to the drive motor 22 by a chain drive mechanism 32, whereby the upper recorrugating and flanging roller 18 can be driven in either a clockwise or counterclockwise direction, as viewed from the central pipe support 14. Lower shaft 28, which carries the lower roller 20, is journaled at the forward end thereof in support 34 and at its rearward end in a self aligning pillow block 36. The lower shaft 28 carries a gear 35 thereon which meshes with a gear 37 carried by the upper drive shaft 26, whereby the lower recorrugating and flanging roller 20 is driven in the opposite direction of roller 18. As seen in FIG. 5, the forward lower shaft support 34 is carried by and secured to a transverse support bar 39 which is, in turn, carried by a hydraulic piston 29 disposed within and extending upwardly from a fixed cylinder 38. The hydraulic piston is operable to raise and lower the transverse support bar 39 and lower shaft support 34 and thereby correspondingly raise and lower the lower recorrugating and flanging roller 20 into and out of the operative position, as will be described. The self aligning pillow block 36 in which the rearward end of the lower shaft is journaled allows that end to undergo the necessary travel caused by the hydraulic piston 29.

Figure 1:
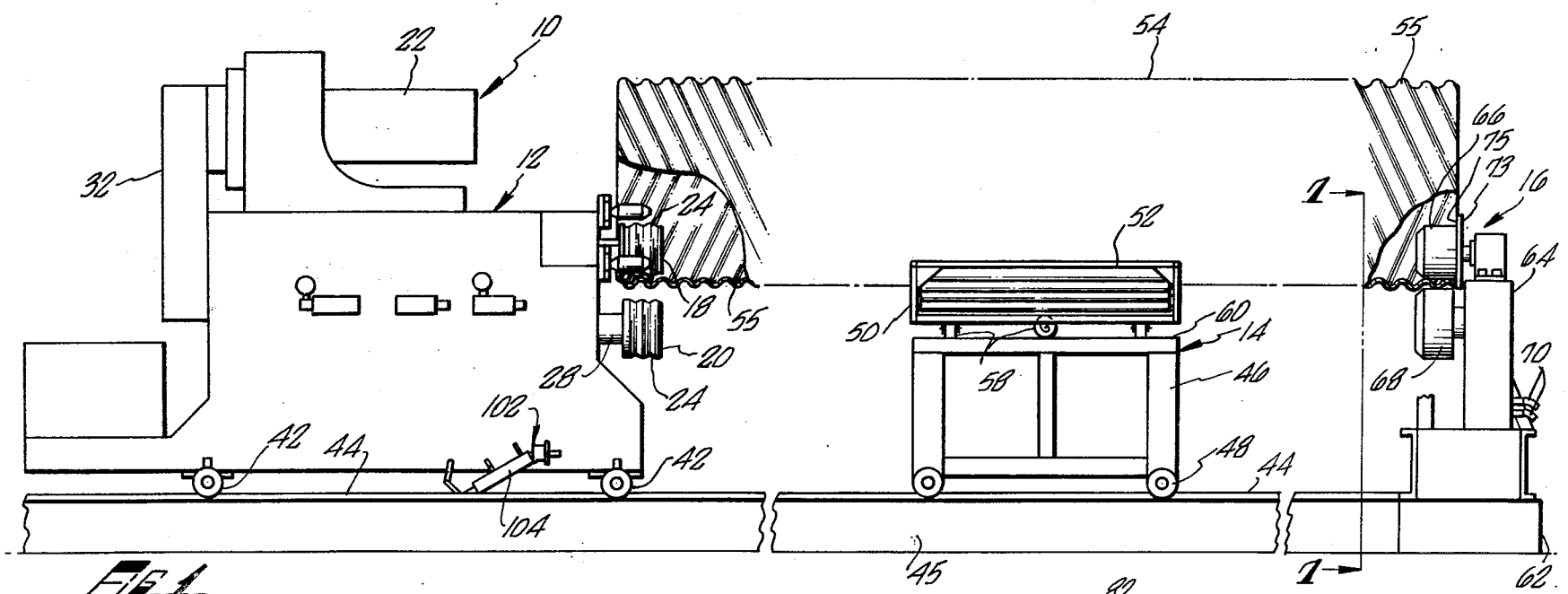
FIG. 1 is a partial sectional side view of the flange forming assembly with a length of spirally wound corrugated pipe positioned thereon.
Figure 3:
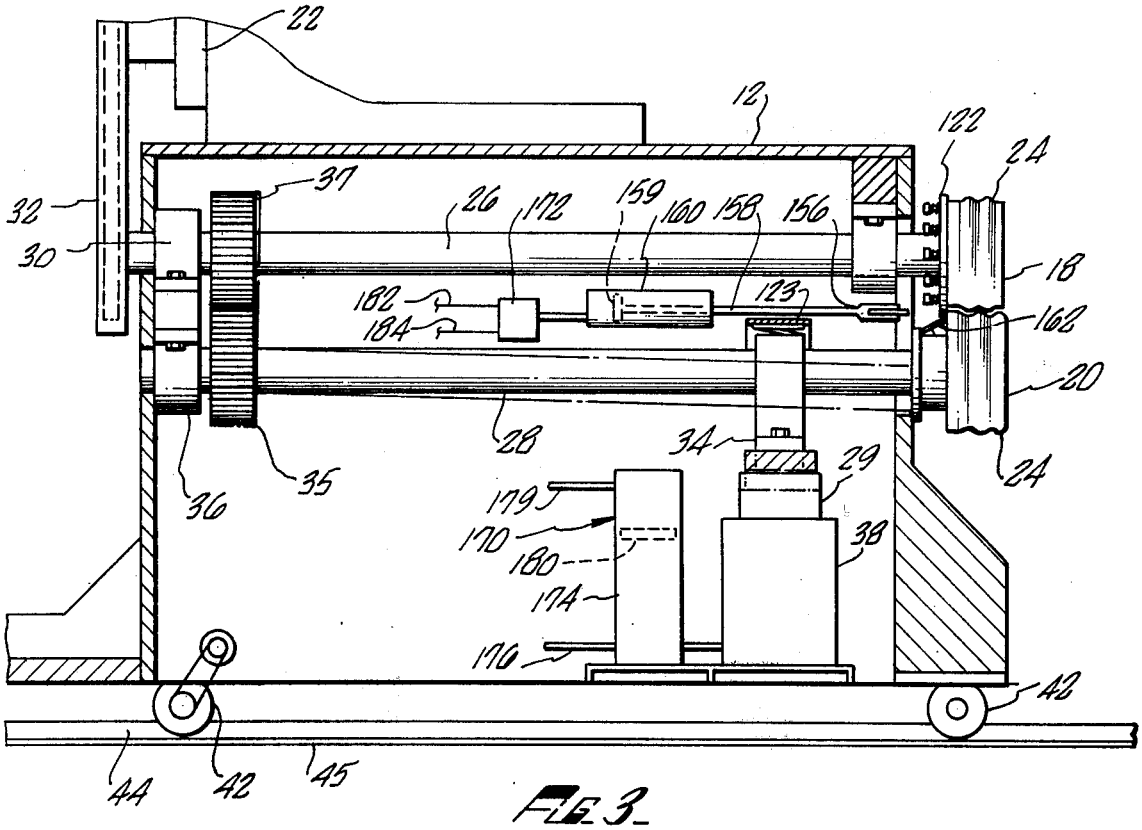
FIG. 3 is a sectional view of a portion of the head stock illustrating the recorrugating and flanging rollers and drive and lifting mechanisms.

As seen in FIGS. 1 and 3, the head stock 12 is supported by wheels 42 which freely ride on a track 44 which is illustrated mounted on raised concrete supports 45. The central pipe support 14 also rides on track 44 and is comprised of a frame 46, wheels 48 and turntable 50. The turntable has a plurality of elongated support rollers 52 thereon for supporting a length of pipe 54 having spirally formed corrugations 55 therein. The turntable is, in turn, pivotally mounted on the frame 46 by a central pivot (not shown) and is supported thereon by a plurality of pivotally mounted wheels 58 which ride on a flat support surface 60. Rotational mounting of the turntable with respect to the frame allows the turntable to be rotated to facilitate loading a length of pipe thereon and to bring the other end of the pipe into engagement with the head stock after the first end has been flanged. As will become apparent, several different embodiments of a central pipe support could be employed with the present invention, and support 14 is merely illustrative of one such embodiment.

Figure 8:
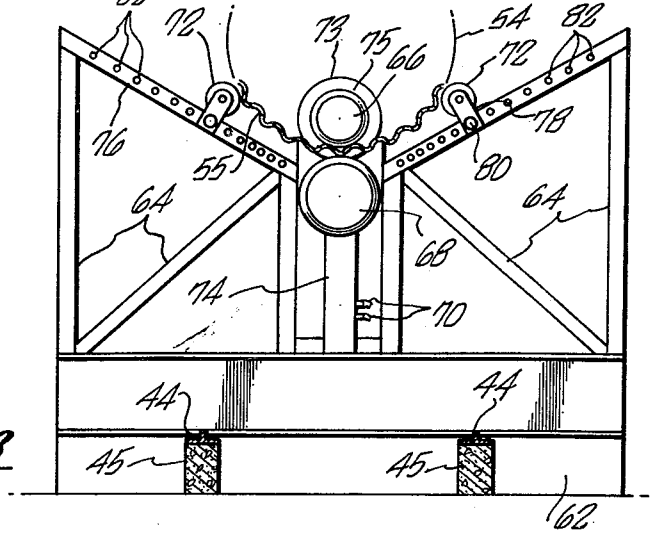
FIG. 8 is a frontal view of the tail stock showing a portion of a length of corrugated pipe thereon.

The tail stock 16, as shown if FIGS. 1 and 8, is rigidly mounted on a base 62 at one end of track 44 and is comprised of a frame 64, an upper support roller 66, lower support roller 68 and lateral pipe support rollers 72. The upper support roller 66 has an enlarged base portion 73, defining a pipe contact surface 75 and is rigidly affixed to the frame 64. The lower support roller 68 is mounted on a hydraulic lifting mechanism 74 which is operable via hydraulic lines 70 to raise and lower the lower support roller. The lateral pipe support rollers 72 are mounted on angle arms 76 of the frame by means of brackets 78 and bolt means 80. A plurality of apertures 82 are provided in each angle arm so that the lateral support rollers can be properly positioned along the angle arms according to the diameter of the length of pipe being flanged to properly support the pipe on the exterior surface thereof, as shown in FIG. 8.

In operation, a length of spiral wound corrugated pipe 54 is positioned on the elongated support rollers 52, the central pipe support 14. The turntable 50 is then rotated, bringing the pipe into alignment with the flanging assembly. The central pipe support is then moved along track 44 until one of the pipe abuts the pipe contact surface 75 of the upper support roller 66 on the tail stock 16, the remainder of the roller being disposed inside the length of pipe 54, as shown in FIGS. 1 and 8. The lateral pipe support rollers are disposed along the angle arms 76 of the frame to abut the outer surface of the pipe. The hydraulic lifting mechanism 74 is then actuated to raise the lower support roller 68 into contact with the underside of the pipe. In this position, the pipe length abuts contact surface 75 of the upper support roller and is in contact with the surfaces of the upper and lower support rollers 66 and 68 and the lateral pipe support rollers 72. Each of these rollers is freely rotatable, thereby allowing the pipe length 54 to rotate when driven by the recorrugating and flanging rollers 18 and 20 of the head stock 12 while preventing any undesirable lateral movement of the pipe length.

After the pipe length has been secured to the tail stock 16, the head stock 12 is moved along track 44 into engagement with the other end of the pipe length which is to be flanged, as shown in FIGS. 1 and 5. The head stock is provided with a plurality of thrust rollers 84 which are angularly disposed and rotatably mounted on a plate 86. Plate 86 is secured to the facing 88 of the head stock 16 by bolt means 90 and 91 and is provided with an adjusting slot 92, so that the plate may be pivoted about bolt means 90 to properly dispose the thrust rollers for pipes of varying diameters. In addition, a plurality of shims 93 are disposed between the plate 86 and head stock facing 88 to allow the pipe to be moved varying distances onto the recorrugating and flanging rollers and thereby varying the length of the flange which will be formed, as will be described.

Figure 2:
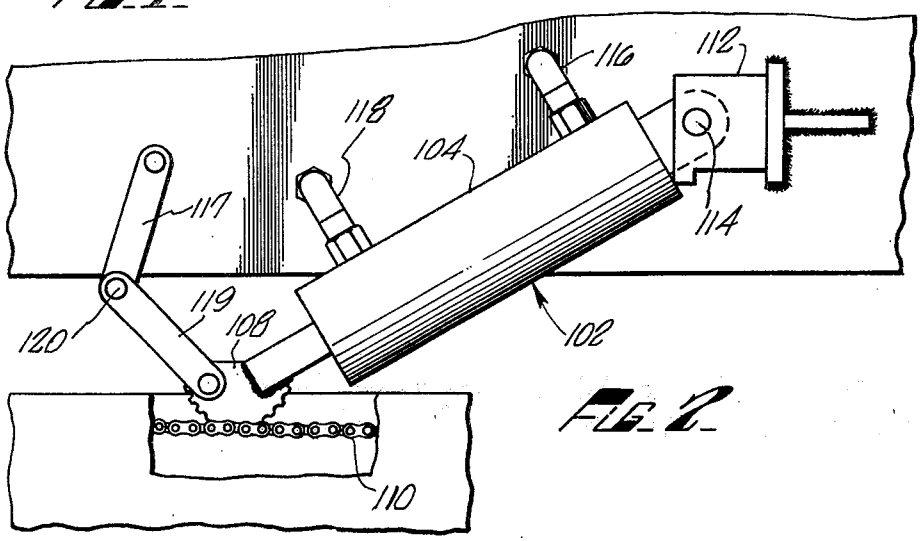
FIG. 2 is an enlarged view of the head stock locking mechanism.

The head stock facing 88 is also provided with an internal containing roller 94 and an external containing roller 96 which are mounted in elongated brackets 98 and 100, respectively. Brackets 98 and 100 are each provided with a plurality of apertures 99 and 101, respectively, so that the positioning of the containing rollers can be adjusted to pipe lengths of varying diameters and secured to the brackets by bolt means 103. When the head stock 12 is moved into engagement with the pipe length, the upper recorrugating and flanging roller 18 and internal containing roller 94 are disposed within the pipe length and against the inside surface thereof. The external containing roller 96 is disposed against the external surface of the pipe length and the lower recorrugating and flanging roller 20 is disposed below and out of contact with the external surface of the pipe length. The head stock is then locked in place by the hydraulically actuated securing means 102 shown in FIGS. 1 and 2.

The securing means is comprised of a hydraulic cylinder 104, piston (not shown), ratchet 108 and locking chain 110. The cylinder is pivotally secured to the head stock by bracket 112 and locking pin 114 and communicates with a supply of hydraulic fluid through lines 116 and 118. The ratchet 108 is also pivotally secured to the head stock by means of lever arms 117 and 119 which are pivotally joined by pin 120. when hydraulic fluid is introduced into the hydraulic cylinder through line 116, the piston is driven downwardly, locking the ratchet in chain 110 which runs parallel with the track 44. When the ratchet is held within the locking chain by the force of the hydraulic fluid on piston 106, the head stock is firmly held in place on track 44.

After the head stock as been urged into position and secured, the hydraulic piston 29 is activated to raise the lower recorrugating and flanging roller 20 into contact with the underside of pipe 54 and presses the underside of the pipe against the upper reflanging and recorrugating roller 18. In the inactivated state, the lower recorrugating and flanging roller 20 is biased downwardly by the weight thereof and coil springs 121 which are disposed on either side of the lower shaft support 34 and piston 29 and secured at their upper ends by stops 123 and press against the transverse support bar 39 on which the forward shaft support 34 is carried. Upon activation of the hydraulic piston 19, the pressure exerted on the pipe by the lower roller 20 depends on the gauge of the pipe length being flanged. With 16 gauge steel (0.162 cm in wall thickness), a pressure of about 28 to 29.75 kg/cm$^2$ (400 to 425 psi) has been found to be desirable; with 14 gauge steel (0.20 cm), 35 to 36.75 kg/cm$^2$ (500 to 525 psi); and with 12 gauge steel (0.277 cm), 42 to 42.75 kg/cm$^2$ (600 to 625 psi).

As the lower recorrugating and flanging roller 20 is raised to press the pipe against the upper recorrugating and reflanging roller 18, hydraulically actuated containment roller 125 mounted on the head stock (see FIG. 5) is urged into contact with the exterior surface of the pipe length by means of a piston rod 127 extending from a hydraulic cylinder 129. Roller 125 together with the internal and external containing rollers 94 and 96 hold the pipe securely in place as it is recorrugated and flanged by rollers 18 and 20 and the additional apparatus which will be presently described.

Figure 7:
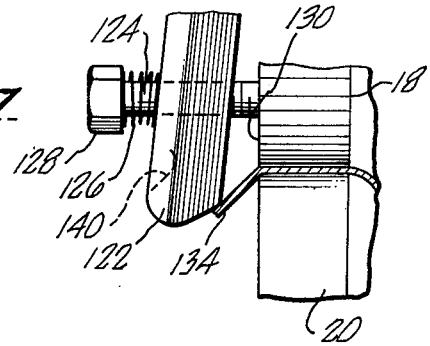
FIG. 7 is a side view of the roller and ironing plate in the initial flange forming stage.

When the drive motor 22 is activated, the upper roller 18 is driven in a clockwise direction, causing the lower roller 20 to rotate in a counterclockwise direction, whereby the pipe length 54 disposed therebetween is caused to rotate in a clockwise direction, as viewed from the front of the head stock. During rotation, the pipe length is firmly held at its forward end by the upper and lower recorrugating and flanging rollers 18 and 20, containment rollers 94 and 96 and the hydraulically actuated roller 125, while the rear end of the pipe is held by the upper and lower support rollers 66 and 68 and the lateral support rollers 72 of the tail stock. While the foregoing rollers act to precisely position the pipe for the formation of the flange, the central pipe support 14 carries the bulk of the pipe weight. The corrugations 24 in the surfaces of the upper and lower recorrugating and flanging rollers 18 and 20 of the head stock under the pressure of the hydraulic piston 29 detent the forward end of the pipe with its spiral corrugations therein and the rotation of the rollers 18 and 20 reforms the spiral corrugations at the end of the pipe into two annular corrugations 131, illustrated in FIG. 6. The recorrugating of the end of the pipe length into two annular corrugations occurs with one revolution of the pipe. This revolution is directed in a clockwise direction to prevent the pipe length from tending to screw away from the head stock due to the spiral corrugations therein. During this revolution, the forming of the flange is also begun. The upper recorrugating and flanging roller has an ironing plate 122 (see FIGS. 6 and 7) secured to the inner end thereof by a plurality of bolt means 124. Springs 126 are disposed about the bolts and extend between the enlarged heads 128 thereof and the inner surface 130 of the roller 18 to urge the plate 122 against the roller. During the clockwise revolution of the pipe length 54, the ironing plate is disposed outwardly from the inner surface 130 of roller 18 by the force exerted thereon by the end of the pipe length, as seen in FIG. 7. The pressure exerted by the plate, however, is sufficient to flare the end of the pipe outwardly at an angle of about 45° and thereby starts the formation of the flange 134. The length of the forming flange 134 is determined by the distance the pipe length extends beyond the lower recorrugating and flanging roller 20 and can be easily adjusted by the number of shims 93 disposed behind the plate 86 which carries the thrust rollers 84 on the face of the head stock 12; the greater the distance the thrust rollers protrude from the face of the head stock, the shorter the flange.

Figure 4:
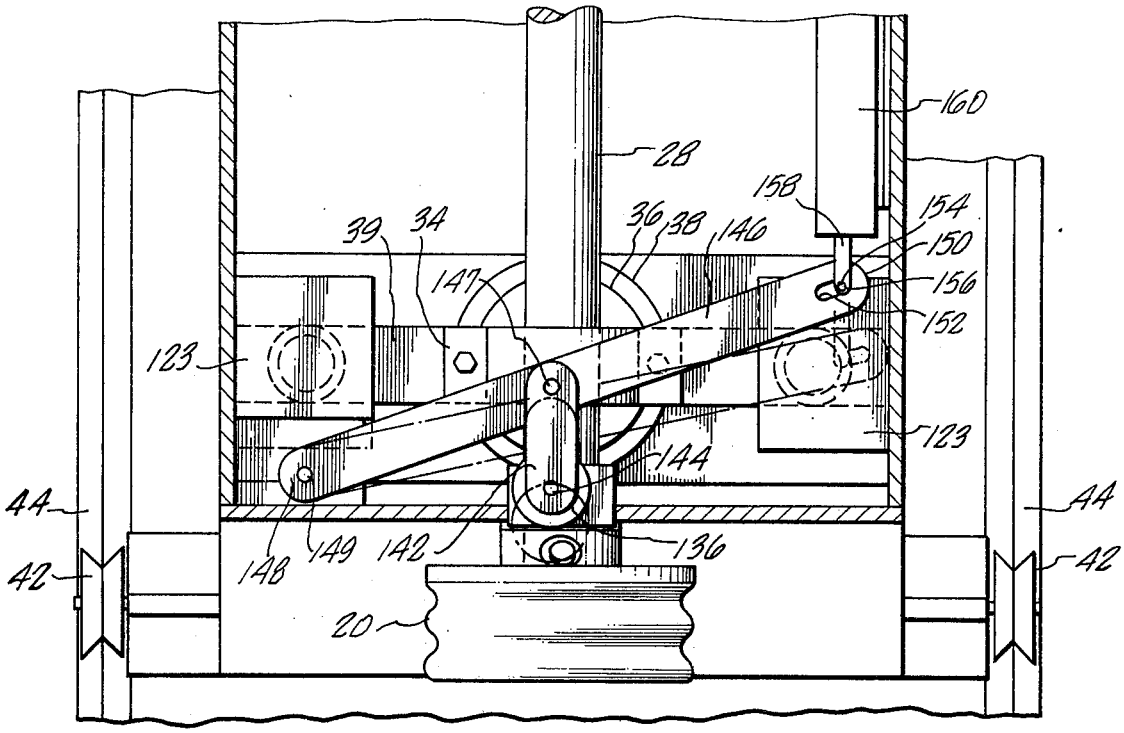
FIG. 4 is a partial sectional view of the head stock illustrating the ironing wheel mounting assembly.

After a single revolution of the recorrugating and flanging rollers and consequently pipe 54 during which the annular corrugations are imparted to the pipe length and the formation of the end flange begun, the direction of rotation of the rollers 18 and 20 is reversed, causing the pipe length to rotate in a counterclockwise direction to prevent the shearing wheel 162 which trims the formed flange, as will be discussed, from catching on the angularly approaching lock seam of the forming flange and thereby damage the flange. At this time, an ironing wheel 136 (see FIGS. 4 and 6) is hydraulically actuated to push the ironing plate 122 against the forming flange 134 and press the flange flat against the inner surface 138 of the lower roller 20. The ironing plate has an annular channel 140 therein to receive the ironing wheel which is journaled in the forward end of a mounting arm 142 and affixed thereto by a pin 144. The mounting arm 142 is pivotally secured to a transverse actuating arm 146 (see FIG. 4) by a pin 147, which, in turn, is pivotally secured at the forwardly extended end 148 thereof to the head stock by pin 149. The rearwardly extended end 150 of the actuating arm has a slot 152 therein through which a pin 154 extends and which, in turn, is secured at its extended ends to a yoke 156 defined by the end of a piston rod 158. The piston rod terminates in a piston head 159 disposed within a hydraulic cylinder 160. The cylinder is in fluid communication within a pressurized supply of hydraulic fluid (not shown) via a hydraulic lines 161 and a pressure regulator 172 which will be described. Actuation of the piston rod causes the actuating arm 146 to pivot about pin 149 and thereby extend the ironing wheel 136 from its retracted position, shown in solid lines in FIG. 4, to its extended or actuated position, shown in FIG. 6 and in phantom lines in FIG. 4, whereupon the flange is pressed flat against the inner surface 138 of the lower roller 20. To prevent the ironing wheel from catching on the edges of the annular channel 140 in the lower roller and in order that the flange 134 can be ironed flat prior to the perimeter portion thereof being engaged by a shearing wheel 162, the ironing wheel is mounted about two centimeters (2 cm) to the left of the central axes of the upper and lower rollers 18 and 20, as viewed from the front of the head stock.

Figure 6:
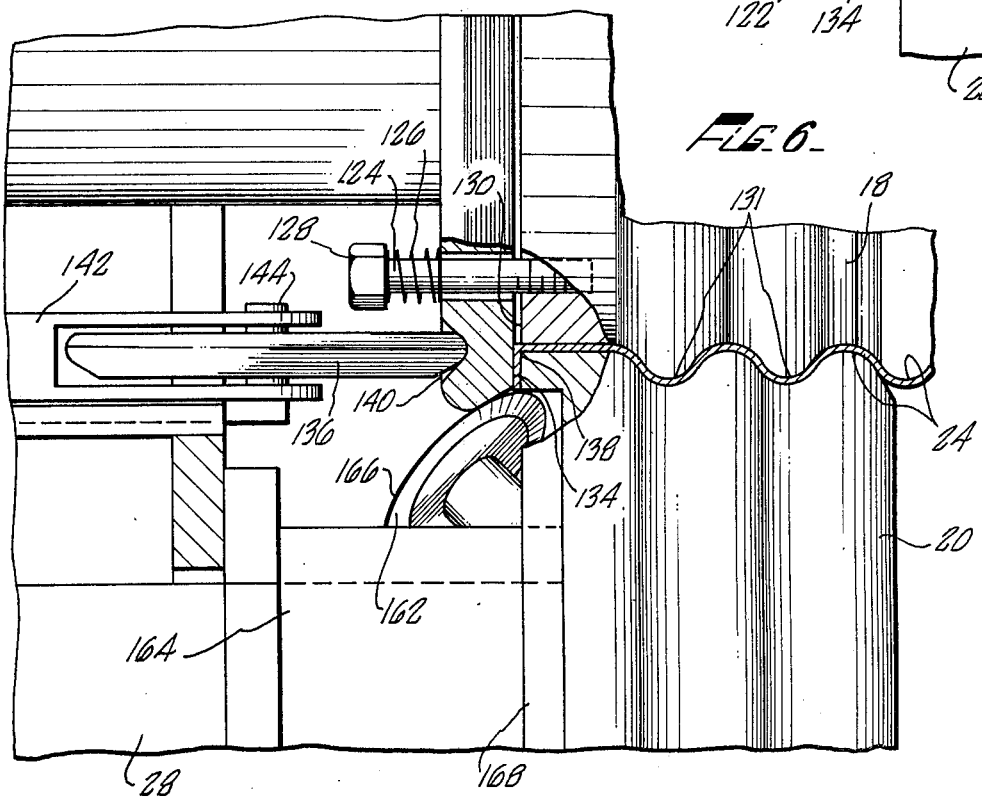
FIG. 6 is an enlarged sectional view of the recorrugating and flanging rollers, ironing plate and wheel and shearing wheel.

While the above mechanism forms an annular flange which extends radially from one end of the pipe, the helical formation of the pipe and deformation involved in creating the flange produces a very irregular flange perimeter. Accordingly, a shearing wheel 162 is angularly and rotatably mounted inwardly of the lower recorrugating and flanging roller 20 on a block 164 carried by lower shaft 28, as seen in FIGS. 5 and 6. The wheel has an annular cutting edge 166 which extends about a half a centimeter into an annular recessed area 168 in the lower recorrugating and flanging roller. While the ironing wheel is mounted to the left of center, the shearing wheel is angularly mounted to the right of center with the cutting edge thereof being on center with respect to the upper and lower rollers 18 and 20, such that when the ironing wheel is actuated to press the ironing plate and forming flange against the inner surface 138 of the lower roller 20, the shearing wheel avoids interfering with the ironing process and severs the excess material from the formed flange to provide an annular flange of relatively constant length.

While the hydraulic assemblies which arise the upper and lower recorrugating and reflanging rollers 18 and 20, the lower support roller 68 on the tail stock, actuate the ironing wheel, laterally dispose the pipe containment roller 125 and secure ratchet 108 to the locking chain 110, all operate in a standard fashion, the hydraulic assemblies which drive piston 29 to raise and lower the lower recorrugating and flanging roller 20 and that which actuates the ironing wheel include pressure-relief mechanisms or accumulators 170 and 172, respectively. A pressure-relief mechanism is necessary to accommodate the varying thickness of the end of the length of spirally wound corrugated pipe. This thickness varies from a single ply of the particular gauge of pipe to four such thicknesses at the lock seam. If such a relief mechanism were not provided, the pressure exerted by the lower recorrugating and flanging roller against the pipe length would flatten the lock seam because of the increased thickness thereof and cause breakage. It is therefore necessary to provide a mechanism to allow the lower roller to back off to accommodate this increase in pipe thickness. The pressure-relief mechanism 170 incorporated herein is best seen in FIG. 3 and includes a hydraulic cylinder 174, the lower end of which is filled with hydraulic fluid through inlet 176 from a pressurized supply (not shown) and is in fluid communication through conduit 178 with lifting cylinder 38 for raising the lower recorrugating and flanging roller 20. A piston 180 is operably disposed within cylinder 174 and the area within the cylinder above the piston is filled with a compressible gas such as nitrogen via conduit 179. In use, the compressible gas within cylinder 174 is pressurized to a given psi through conduit 176, depending on the gauge of pipe being flanged. This pressure corresponds to that to be exerted by the lower roller 20 on the pipe, so if 16 gauge pipe were being used, the gas would be pressurized to about 28 to 29.75 kg/cm² (400 to 425 psi). When the recorrugating and flanging roller strikes a second layer of metal, the pressure exerted by the roller on the pipe would rise above the 28 to 29.75 kg/cm² level, were it not for the compressible gas within cylinder 174, which would then be compressed by the piston 180 and thereby relieve the pressure on piston 29 within the lifting cylinder 34 and allow the piston to back off the amount necessary to maintain the desired pressure or limited pressure range against the end of the pipe length being flanged. In this manner, the lower roller 20 continually maintains the desired pressure range on the pipe, regardless of the varying thickness in the wall thereof. As noted above, a similar mechanism is preferably provided for the hydraulic system for actuating the ironing wheel to prevent undue pressure from being exerted on the formed flange 134. This mechanism generally includes a hydraulic cylinder 173 having fluid inlets 182 and 184 on either side of a piston head disposed therein (not shown) and a conduit 161 communicating the cylinder with actuating cylinder 160.

Various changes and modifications may be made in carrying out the present invention without departing from the spirit and scope thereof. Insofar as these changes and modifications are within the purview of the appended claims, they are to be considered as part of the invention.

We claim:

1. An apparatus for flanging a length of spirally wound corrugated pipe which comprises: means for supporting said pipe length; and a recorrugating and flanging assembly, said assembly including a pair of rollers for gripping one end of said pipe length, said rollers having corrugations on the surfaces thereof, means for driving said rollers to impart annular corrugations to said end of said pipe length, means for flaring said end of said pipe length outwardly therefrom, forming means for converting said outwardly flared end of said pipe length into a substantially perpendicular disposition with respect to the longitudinal axis of said pipe length thereby forming, and means for trimming the perimeter portion of said radial end flange to provide a substantially uniform radial dimension.

2. The combination of claim 1 wherein one of said rollers is adapted to be disposed within said length of pipe and the other of said rollers is adapted to be disposed exteriorly of said length of pipe and including means for drawing one of said rollers to the other of said rollers to bring the surfaces thereof in a mating relationship and gripping contact with said pipe length and means responsive to the thickness of said pipe length for continually maintaining said gripping contact within a predetermined pressure range during rotation of said rollers.

3. The combination of claim 1 wherein said flaring means comprises a plate member carried by one end of one of said rollers and means for biasing said member toward said end of said roller, said plate member extending over a portion of said other roller upon said rollers being disposed in a pipe gripping relationship and said biasing means urging said member against said end of said pipe and flaring said end outwardly therefrom.

4. The combination of claim 1 including means for drawing said rollers into gripping contact with one end of said pipe and means for continuously maintaining said contact within a predetermined pressure range during rotation of said rollers, said constant pressure maintaining means comprising a cylinder having a piston operably therein, the area within said cylinder on one side of said piston containing hydraulic fluid and being in communication with said drawing means and the area within said cylinder on the other side of said piston containing a compressible gas, and means for regulating the pressure of said gas within said cylinder.

5. The combination of claim 3 wherein said pressing means comprises a support member, and ironing wheel journaled in said support member, and means for moving said wheel into engagement with said plate and pressing said plate against said end of said plate carrying roller, thereby pressing the flared end of said pipe against said contact surface to form said radial end flange.

6. An apparatus for flanging a length of spirally corrugated pipe which comprises: means for supporting said pipe length; a recorrugating and flanging assembly including an upper roller adapted to be disposed within said pipe length, a lower roller adapted to be disposed exteriorly of said pipe length, said rollers having corrugations on the surfaces thereof, means for raising said lower roller to bring the surfaces of said rollers into a mating relationship and gripping contact with one end of said pipe length, means for driving said rollers to impart annular corrugations to said end of said pipe length, means carried by one of said rollers for flaring said end of said pipe length outwardly therefrom; means for converting said outwardly flared end of said pipe length into a substantially perpendicular disposition with respect to the longitudinal axis of said pipe length, thereby forming a radial end flange, means responsive to the thickness of said pipe length for maintaining said gripping contact within a predetermined pressure range during rotation of said rollers, and means for trimming the perimeter portion of said flange to provide said flange with a substantially uniform radial dimension.

7. The combination of claim 6 wherein said flaring means comprises a plate member carried by and biased toward one end of said rollers, the other of said rollers defining a flange forming contact surface, said plate member extending radially from the first of said rollers and over at least a portion of said contact surface of said other roller.

8. The combination of claim 6 wherein said constant pressure maintaining means comprises a cylinder having a piston operable therein, the area within said cylinder on one side of said piston containing hydraulic fluid and being in communication with said raising means and the area within said cylinder on the other side of said piston containing a compressible gas, and means for regulating the pressure of said gas within said cylinder.

9. The combination of claim 7 wherein said converting means comprises a support member, an ironing wheel journaled within said support member and means for moving said wheel into engagement with said plate and pressing said plate against said end of said plate carrying roller thereby pressing the flared end of said pipe against said contact surface to form said radial end flange.

10. The combination of claim 8 wherein said compressible gas is nitrogen.

11. The combination of claim 9 wherein said plate member is secured to said end of said roller by a plurality of bolt means, each of said bolt means having enlarged head portions, and including a plurality of biasing springs, one of said springs being disposed about each of said bolts and extending between the enlarged head portions thereof and said plate, said biasing springs being compressible upon said plate member contacting said end of said pipe.

12. The combination of claim 11 wherein said lower roller has an annular recessed area in the inner end thereof and said trimming means comprises a cutting wheel rotatably mounted inwardly of said assembly from said lower wheel, the perimeter portion of said cutting wheel extending into said annular area in said lower wheel for shearing the perimeter portion of said flange to provide said flange with a substantially uniform radial dimension.

13. An apparatus for flanging a length of spirally corrugated pipe comprising: means for supporting said pipe length; a recorrugating and flanging assembly including a drive shaft journaled therein and carrying an upper roller at the extended end thereof, means for rotating said drive shaft, a lower shaft pivotally mounted at one end thereof to said assembly and being driven by said drive shaft in a direction opposite to that of said drive shaft, a lower roller carried by said lower shaft at the other end thereof and defining a flange forming contact surface thereon, said upper and lower rollers having corrugations on the surfaces thereof to impart annular corrugations to one end of said pipe length, means for pivoting said other end of said lower shaft toward said drive shaft to bring the surfaces of said upper and lower rollers into a mating relationship and gripping contact with one end of said pipe length, means responsive to the thickness of said end of said pipe length for maintaining said gripping contact within a predetermined pressure range during rotation of said rollers, a plate member for flaring said end of said pipe length outwardly therefrom, said plate member being carried by one end of said upper roller and extending radially therefrom, means for biasing said plate member toward said end of said roller, a support member, an ironing wheel journaled in said support member such that the axis of rotation thereof is substantially perpendicular to the axes of rotation of said upper and lower rollers, means operable to move said ironing wheel against said plate member and urge said plate member toward said end of said roller, pressing said outwardly flared end of said pipe length against said contact surface and into a substantially perpendicular disposition with respect to the longitudinal axis of said pipe length, thereby forming a radial end flange, and means for trimming the perimeter portion of said flange to provide said flange with a substantially uniform radial dimension.

14. The combination of claim 13 wherein said constant pressure maintaining means comprises a cylinder having a piston operable therein, the area within said cylinder on one side of said piston containing a hydraulic fluid and being in communication with said pivoting means and the area within said cylinder on the other side of said piston containing a compressible gas and means for regulating the pressure of said gas within said cylinder.

15. The combination of claim 14 wherein said compressible gas is nitrogen.

16. The combination of claim 13 wherein said lower roller has an annular recessed area in the inner end thereof and said trimming means comprises a cutting wheel, said wheel being carried by said lower shaft and the perimeter portion thereof extending into said annular area in said lower roller.

17. A method of flanging a length of spirally corrugated pipe comprising the steps of: recorrugating the portion of said pipe length adjacent one end thereof to define annular corrugations therein; flaring said end of said pipe length outwardly therefrom; converting said outwardly flared end of said pipe length into a substantially radial outwardly extending end flange; and trimming the perimeter portion of said end flange to provide it with a substantially uniform radial dimension.

18. A method for flanging a length of spirally corrugated pipe comprising the steps of turning the portion of said pipe length adjacent one end thereof in a given direction between a pair of recorrugating rollers to apply annular corrugations thereto; flaring said end of said pipe length outwardly therefrom; turning said portion of said pipe length between said pair of recorrugating rollers in the opposite direction; converting said outwardly flared end of said pipe length into a substantially radial outwardly extending end flange; and trimming the perimeter portion of said flange to provide it with a substantially uniform radial dimension.

19. The method of claim 18 wherein said recorrugating and flaring steps occur concurrently.

20. An apparatus for flanging a length of spirally corrugated pipe which comprises: recorrugating means for imparting annular corrugations to one end of said pipe length, flaring means for flaring said end outwardly; forming means for converting said outwardly flared end of said pipe length into a substantially radial end flange; and trimming means for trimming the perimeter portion of said radial end flange to provide a substantially uniform radial dimension.

21. The combination of claim 20 wherein said recorrugating means and said flaring means are constructed to act concurrently to flare and to impart annular corrugations to said end of said pipe length.

22. An apparatus for flanging a length of spirally corrugated pipe which comprises: means for supporting said pipe length; and a recorrugating and flanging assembly, said assembly including a pair of rollers for gripping one end of said pipe length, said rollers having corrugations on the surfaces thereof, means for driving said rollers to turn said pipe in a given direction and impart annular corrugations to said end of said pipe length, means for flaring said end of said pipe length outwardly therefrom, means for driving said rollers to turn said pipe in an opposite direction, means for converting said outwardly flared end of said pipe length into a substantially perpendicular disposition with respect to the longitudinal axis of said pipe length thereby forming a radial end flange.

23. The combination of claim 22 including means for trimming the perimeter portion of said radial end flange as said pipe is driven said opposite direction to provide a substantially uniform radial dimension.

24. The combination of claim 22 wherein said recorrugating means and said flaring means concurrently impart annular corrugations to and flare said end of said pipe length.

25. A method of flanging a length of spirally corrugated pipe comprising the steps of turning the portion of said pipe length of adjacent one end thereof in a given direction between a pair of recorrugating rollers to apply annular corrugations thereto; concurrently flaring said end of said pipe length outwardly therefrom; turning said portion of said pipe length between said pair of recorrugating rollers in the opposite direction; and concurrently converting said outwardly flared end of said pipe length into a substantially radial outwardly extending end flange and trimming the perimeter portion of said flange to provide it with a substantially uniform radial dimension while said pipe length is being turned in said opposite direction.

26. A method for flanging a length of spirally corrugated pipe comprising the steps of turning the portion of said pipe length adjacent one end thereof in a given direction between a pair of recorrugating rollers to apply annular corrugations thereto; continually maintaining said rollers against said pipe length at a pressure within a predetermined range; flaring said end of said pipe length outwardly therefrom; turning said portion of said pipe length between said pair of recorrugating rollers in the opposite direction, converting said outwardly flared end of said pipe length into a substantially radial outwardly extending end flange; and trimming the perimeter portion of said flange to provide it with a substantially uniform radial dimension.

* * * * *